US006544129B2

(12) United States Patent
Todd

(10) Patent No.: US 6,544,129 B2
(45) Date of Patent: Apr. 8, 2003

(54) SHOCK AND VIBRATION DAMPENING DEVICE FOR A GOLF CLUB

(76) Inventor: David A. Todd, 7281 Orchard Dr., Ontario, NY (US) 14519

( * ) Notice: Subject to any disclaimer, the term of this patent is extended or adjusted under 35 U.S.C. 154(b) by 0 days.

(21) Appl. No.: 09/790,196

(22) Filed: Feb. 19, 2001

(65) Prior Publication Data

US 2002/0115499 A1 Aug. 22, 2002

(51) Int. Cl.[7] ..... A63B 53/10; A63B 53/12

(52) U.S. Cl. ..... 473/318

(58) Field of Search ..... 473/318, 520, 473/521, 201, 203, 206, 212, 559, 564

(56) References Cited

U.S. PATENT DOCUMENTS 3,227,455 A * 1/1966 Hulsman
5,236,198 A 8/1993 Haines et al.
5,294,119 A 3/1994 Vincent et al.
5,584,482 A * 12/1996 Huang
5,618,041 A * 4/1997 Huang
5,649,467 A * 7/1997 Sangret
5,674,135 A 10/1997 Franco et al.
5,735,752 A 4/1998 Antonious
5,943,758 A * 8/1999 Haas
5,954,591 A 9/1999 Liberatore
6,042,485 A * 3/2000 Cheng

* cited by examiner

*Primary Examiner*—Stephen Blau
(74) *Attorney, Agent, or Firm*—Sturm & Fix LLP

(57) ABSTRACT

A vibration dampening device (10) for use on the shaft (101) of a golf club (100) to reduce the vibration generated along the shaft (101) of a golf club (100) by a mis-hit golf shot wherein the device (10) includes: a strip (20) of elastomeric material (21) dimensioned to partially surround the shaft (101) of a golf club; a split ring clip member (30) having an expansible vertical slot (35) dimensioned to receive both the shaft of (101) of a golf club (100) and the strip (20) of elastomeric material (21); and, a capture unit (13) including a strip of adhesive tape (41) dimensioned to encircle the split ring clip member (30) at least once.

20 Claims, 2 Drawing Sheets

SHOCK AND VIBRATION DAMPENING DEVICE FOR A GOLF CLUB

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of vibration dampening devices for the handles of sports equipment in general, and in particular to a spring-biased shock dampening device for use on golf clubs.

2. Description of Related Art

As can be seen by reference to the following U.S. Pat. Nos. 5,236,198; 5,294,119; 5,674,135; 5,735,752 and 5,954,591, the prior art is replete with myriad and diverse vibration dampening devices and for sports equipment, including golf clubs and the like.

While all of the aforementioned prior art constructions are more than adequate for the basic purpose and function for which they have been specifically designed, they are uniformly deficient with respect to their failure to provide a simple, efficient, and practical dampening device that is specifically designed to be quickly and easily installed and removed from the shaft of a golf club without the need to physically alter the golf club construction or remove the hand grip portion of the club.

As most weekend or average golfers are well aware, they are simply not proficient enough to make pure contact with the "sweet spot" on the face of their golf clubs on a consistent basis; and this failure to execute a perfect swing results in a significant amount of vibration and impact shock being transmitted back along the shaft of their golf clubs, resulting in fatigue as well as problems with tendinitis, arthritis, etc.

As a consequence of the foregoing situation, there has existed a longstanding need for a new and improved vibration dampening device that can quickly and easily be installed on the shaft of a golf club without any special tools or equipment to reduce the physical ramifications of mis-hit shots, and the provision of such a device is the stated objective of the present invention.

BRIEF SUMMARY OF THE INVENTION

Briefly stated, the present invention provides a vibration dampening device that forms the basis of the present invention comprising in general a dampening unit, a spring biased clip unit that captively engages the dampening unit relative to the shaft of a convention golf club and a captive unit that prevents the clip unit from becoming accidently disengaged from the dampening unit.

As will be explained in greater detail further on in the specification, the dampening device is intended to provide a non-selective frequency attenuating attachment for the shaft of a golf club covering a range of frequencies 0–2 kHz and having a dampening efficiency of approximately 60% to 70%.

For example, the dampening unit includes a strip of elastomeric material dimensioned to substantially encircle the periphery of the shaft of a golf club and fabricated from a viscoelastic polymer designed to reduce the transmission of vibrations.

In addition, the strip of elastomeric material is designed to be adhesively secured to the shaft of a golf club and then further pre-compressed by a clip unit including a split ring clip member dimensioned to partially encircle the dampening unit and the golf club shaft, wherein the clip member has a vertical slot whose opening can be contracted by a capture unit including a strip of adhesive tape that is wrapped completely around the clip member at least once to further compress the dampening unit and insure that the dampening unit remains in place on the golf club shaft.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
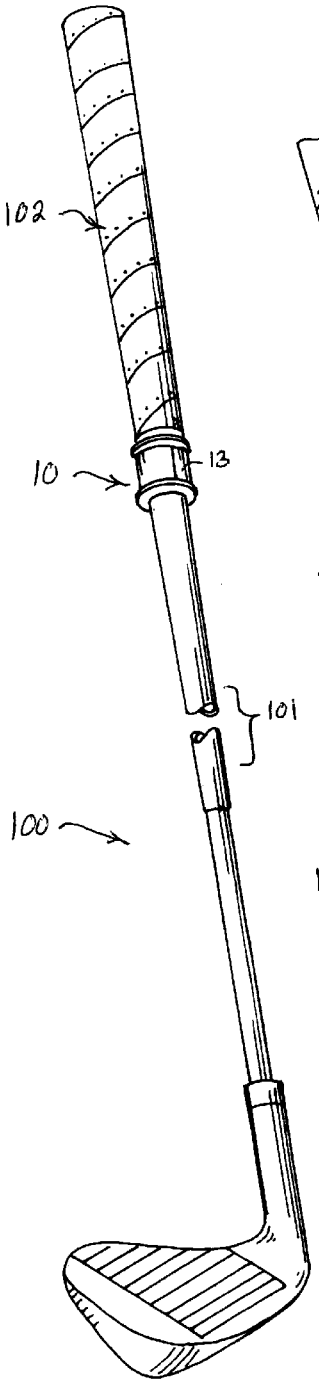
FIG. 1 is a perspective view of the vibration dampening device installed on a conventional golf club.
Figure 2:
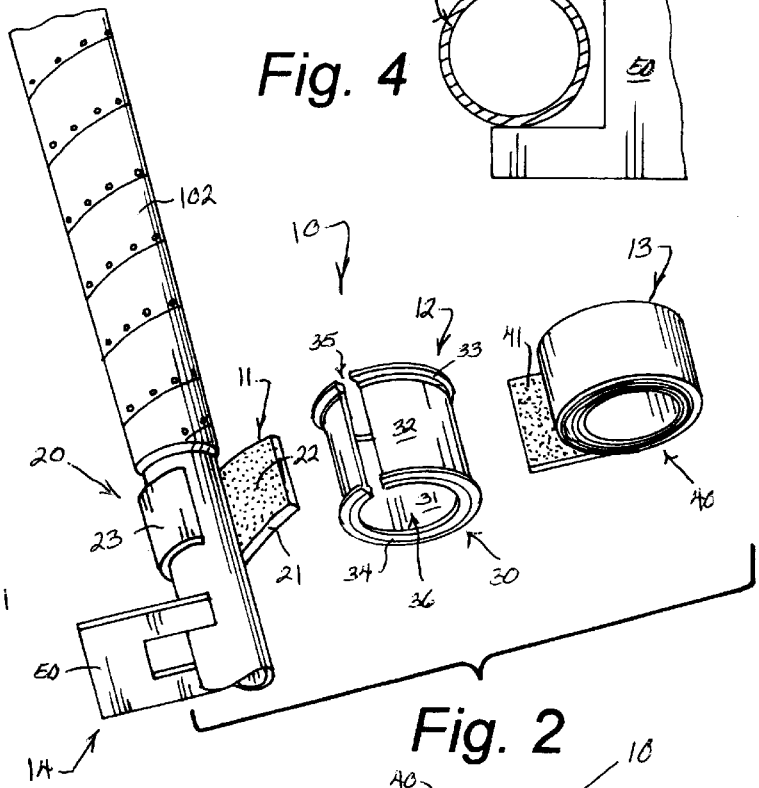
FIG. 2 is an exploded perspective view showing the compartments of the dampening device relative to the shaft of a golf club.

As can be seen by reference to the drawings, and in particularly to FIG. 1, the vibration dampening device that forms the basis of the present invention is designated generally by the reference number 10. In addition, as shown in FIG. 2, the dampening device 10 comprises in general a dampening unit 11, a spring biased clip unit 12, and a captive unit 13. These units will now be described in seriation fashion.

As shown in FIG. 2, the dampening unit 11 comprises a strip 20 of elastomeric material 21, preferably a viscoelastic polymer having a Durometer range between 25 and 40 and Shore 00 scale, that will be coated on at least one side (preferably the interior surface) with a suitable pressure sensitive adhesive to secure the dampening unit 11 to the exterior surface of the shaft 101 of a golf club 100.

In the preferred embodiment of the invention illustrated in FIG. 2, the strip 20 of elastomeric material 21 will have a width of approximately 1⅛ inches, a thickness of approximately ⅛ inch, and a length of approximately 2¼ inches which can be trimmed down to encircle the shaft 101 of a golf club 100 without the strip 20 of elastomeric material overlapping itself.

In addition, in the preferred embodiment both the interior and exterior sides of the strip 20 of elastomeric material 21 will be provided with a pressure sensitive adhesive coating to provide an adhesive attachment between the interior surface 22 of the strip 20 of elastomeric material 21 and the exterior surface of the golf club shaft 101 as well as an adhesive attachment between the exterior surface 23 of the strip 20 of elastomeric material 21 and the interior surface of the spring biased clip unit 12.

Figure 5:
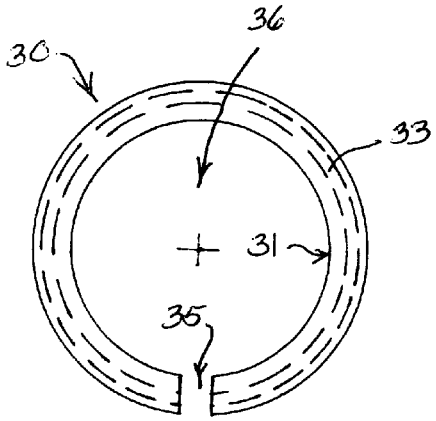
FIG. 5 is an isolated top plan view of the spring biased clip unit.
Figure 6:
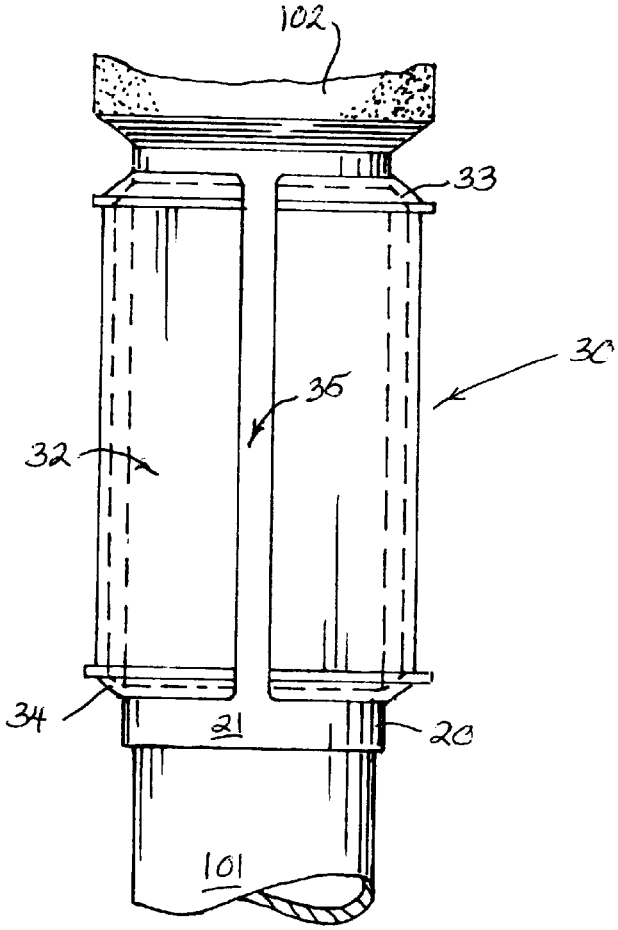
FIG. 6 is an enlarged detail view of the dampening unit and the spring biased clip unit engaged on the shaft of a golf club.

As be best be seen by reference to FIGS. 2, 5 and 6, the spring biased clip unit 12 compresses an elongated split ring clip member 30 having a generally smooth interior surface 31 and an exterior surface having an elongated generally smooth intermediate portion 32 flanked on opposite ends by an upper 33 and a lower 34 collar element whose purpose and function will be explained further on in the specification.

In addition, the clip member 30 is further provided with an elongated vertical slot 35 which allows the central opening 36 of the split ring clip member 30 to be resiliently expanded to accommodate both the shaft 101 of the golf club 100 and the strip 20 of elastomeric material 21 and to subsequently apply a pre-loading pressure on the strip 20 of elastomeric material 21 in a well-recognized manner.

Figure 3:
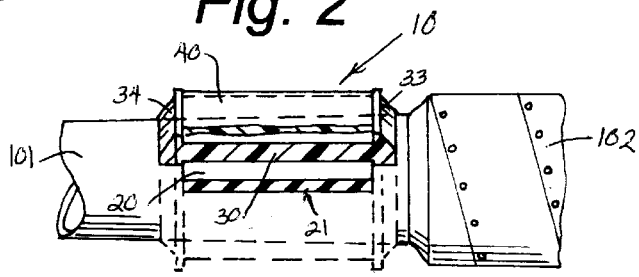
FIG. 3 is a partial cutaway view of the device installed on the shaft of a golf club.

Turning now to FIGS. 2 and 3, it can be seen that the capture unit 13 comprises a roll 40 of one sided adhesive tape 41 wherein the adhesive tape 41 is dimensioned to be received on the intermediate portion 32 of the split ring clip member 30 to both cover the vertical slot 35 in the clip member 30 and to enhance the compressive loading applied by the clip member 30 on the strip 20 of elastomeric material.

In the preferred embodiment of the invention depicted in FIG. 3, the adhesive tape 41 is wrapped at least twice around the periphery of the intermediate portion of the split ring clip member 30 to both prevent the vertical slot 35 from enlarging to allow the clip member 30 from becoming disengaged from the strip 20 of elastomeric material 21 and/or the shaft 101 of the golf club 100, as well as to constrict the opening of the vertical slot 35 to increase the compressive forces exerted by the clip member 30 on the strip 20 of elastomeric material 21.

Figure 4:
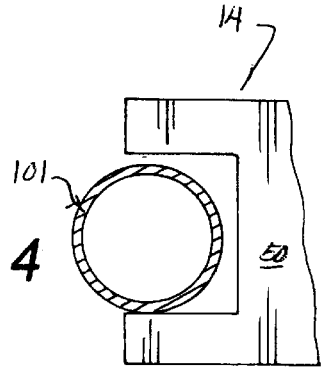
FIG. 4 is a top plan view of a guide template that is used to select an installation location of the shaft of the golf club.

As can also be appreciated by reference to FIGS. 2 and 4, there will be certain instances when the diameter of the golf shaft 101 even with the additional thickness imparted by the dampening unit 11 will still be too small to be effectively engaged by the split ring collar member 30.

In those instances, a gauge unit 14 in the form of a template member 50 will be employed to determine whether or not the dampening unit will have to be built-up by the use of one or more overlapping layers of adhesive tape 41 being wrapped around the exterior surface of the strip 20 of elastomeric material 21 prior to engaging the split ring clip member 30 in the usual fashion and then employing the adhesive tape 41 as mentioned previously.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A vibration dampening device for use on the shaft of a golf club to reduce the vibrations generated along the shaft of the golf club by a mis-hit golf shot, wherein the device comprises:

a dampening unit including a strip of elastomeric material dimensioned to substantially encircle the external periphery of a golf club shaft below the grip portion of the golf club, wherein at least the interior surface of the strip of elastomeric material is provided with an adhesive coating to affix the strip of elastomeric material to the exterior surface of the golf club shaft;

a clip unit including a split ring clip member having a vertical slot whose opening is expandable to receive both the dampening unit and the periphery of the shaft of a golf club;

a capture unit including a strip of adhesive tape that is dimensioned to at least cover the vertical slot in the split ring member and to encircle the split ring clip member at least once; and wherein the exterior of the split ring clip member has an elongated intermediate portion flanked on opposite ends by an upper and lower collar element.

2. The device as in claim 1, wherein the strip of elastomeric material comprises a viscoelastic polymer.

3. The device as in claim 2, wherein the viscoelastic polymer has a Durometer range of 25–40.

4. The device as in claim 3, wherein the viscoelastic polymer has a Shore 00 scale.

5. The device as in claim 2, wherein the strip of elastomeric material only partially surrounds the periphery of the shaft of a golf club.

6. The device as in claim 2, wherein the strip of elastomeric material almost completely surrounds the periphery of the shaft of a golf club.

7. The device as in claim 1 wherein the capture unit includes a strip of adhesive tape that completely surrounds the strip of elastomeric material and the periphery of the shaft of a golf club at least once.

8. The device as in claim 1 further comprising means for applying a selected compressive force to the exterior surface of the strip of elastomeric material.

9. The device as in claim 8 wherein said means includes the strip of adhesive tape that completely encircles said strip of elastomeric material.

10. The device as in claim 8 wherein said means includes the split ring clip member dimensioned to receive both the strip of elastomeric material and the shaft of a golf club.

11. The device as in claim 10 wherein said means further includes the strip adhesive tape that is dimensioned to encircle the strip of elastomeric material and the shaft of a golf club at least once.

12. The device as in claim 1 further comprising a capture unit including a strip of adhesive tape which cooperated with the strip of elastomeric material to completely surround the shaft of a golf club.

13. A vibration dampening device for use on the shaft of a golf club to reduce the vibrations generated along the shaft of the golf club by a mis-hit golf shot, wherein the device comprises:

a dampening unit including a strip of elastomeric material dimensioned to substantially encircle the external periphery of a golf club shaft below the grip portion of the golf club;

a clip unit including a split ring clip member having a vertical slot whose opening is expandable to receive both the dampening unit and the periphery of the shaft of a golf club;

a capture unit including a strip of adhesive tape that is dimensioned to at least cover the vertical slot in the split ring clip member; and wherein the exterior of the split ring clip member has an elongated intermediate portion flanked on opposite ends by an upper and lower collar element.

14. The device as in claim 13, wherein the strip of elastomeric material comprises a viscoelastic polymer.

15. The device as in claim 14, wherein the viscoelastic polymer has a Durometer range of 25–40.

16. The device as in claim 15, wherein the viscoelastic polymer has a Shore 00 scale.

17. The device as in claim 14, wherein the strip of elastomeric material only partially surrounds the periphery of the shaft of a golf club.

18. The device as in claim 14, wherein the strip of elastomeric material almost completely surrounds the periphery of the shaft of a golf club.

19. The device of claim 13, wherein the capture unit includes a strip of adhesive tape that completely surrounds the strip of elastomeric material and the periphery of the shaft of a golf club at least once.

20. The device as in claim 13, wherein said strip of adhesive tape is further dimensioned to encircle the split ring clip member at least once.

* * * * *